United States Patent [19]

Baum

[11] Patent Number: 5,005,324

[45] Date of Patent: Apr. 9, 1991

[54] SHIPPING AND STORAGE CASING

[75] Inventor: Seymour Baum, Englewood Cliffs, N.J.

[73] Assignee: Gussco Manufacturing, Inc., Brooklyn, N.Y.

[21] Appl. No.: 564,162

[22] Filed: Aug. 7, 1990

[51] Int. Cl.[5] ..... E04B 1/00

[52] U.S. Cl. ..... 52/98; 52/105

[58] Field of Search ..... 52/98, 105; 411/174, 411/175; 24/703.2, 703.5

[56] References Cited

U.S. PATENT DOCUMENTS 2,221,854 11/1940 Zalkind ..... 52/100

*Primary Examiner*—David A. Scherbel
*Assistant Examiner*—Joanne C. Downs
*Attorney, Agent, or Firm*—Brumbaugh, Graves, Donohue & Raymond

[57] ABSTRACT

The casing of a file shipping and storage container incorporates a reinforcing member along a pair of opposite walls at an end opening in which an external leg portion forms a right angle with a flange portion at a juncture that is smooth and uninterrupted and in which an internal leg portion forms a juncture with the flange portion that includes a row of aligned, lengthwise, longitudinally spaced-apart slits forming a bending line.

5 Claims, 2 Drawing Sheets

SHIPPING AND STORAGE CASING

BACKGROUND OF THE INVENTION

A popular way of shipping or storing records and files is in a container that consists of a drawer received in a casing. Such containers are widely marketed by the assignee of the present invention under the trademark "Transfile®." While containers of this type can be made of various sheet materials, such as plywood or fiberboard, they are usually made of corrugated boxboard. To enable easy access to the contents of the container, the casing is often made with an opening at one end so that the file drawer can be slid out. The opening is reinforced by metal reinforcing members.

The "Transfile®" containers sold over many years have casings that are constructed in the manner shown in FIGS. 1 to 5 of the accompanying drawings. The construction is based in large part on an invention described and shown in U.S. Pat. No. 2,221,854 (Zalkind, Nov. 19, 1940). The casing 20 comprises a body 22 of corrugated boxboard having top and bottom walls 24 and 26, side walls 28 and 30 and an end wall at one end (not shown). It is produced as a onepiece blank with bending lines that facilitate erecting it from a flattened form in which it is shipped and stored. When erected for use (FIG. 1), it has an end opening 32 through which a drawer is inserted.

The opening 32 is shaped and rigidified against buckling by reinforcing elements in the form of channel- or U-shaped metal strips 34 that fit over the edges of the top and bottom walls 24, 26. The juncture between the two legs of the strip 34 is enlarged and receives the base portion of a U-shaped bar 36, only a portion of which is visible in FIG. 1. An arm at each end of each bar extends at a right angle to the base portion and extends into a corresponding reinforcing member 38, one of which fits over the edge of each of the two side walls 28 and 30 of the casing body at the opening 32. The bars 36 establish and maintain the rectangular shape of the casing opening. The reinforcing members 38 and elements 34, along with the bars in the case of the top and bottom walls, keep the walls of the casing from buckling at the opening.

The reinforcing elements and members are assembled onto the casing at the factory. The elements 34 are made and assembled onto the body in the condition in which they are shown in FIG. 1, except that the bars 36 are rotated, relative to the erected form, 90 degrees so that they lie in the planes of the top and bottom walls. The reinforcing members 38 are manufactured in the form shown in FIG. 4 and are assembled to the boxboard body in that form. The member 38 consists of an inner leg portion 40 that is substantially planar, but with a slight offset 42, and has a rolled bead 44 at its free end, which adds stiffness, presents an inset guide surface for the file drawer, and provides a smooth edge. An outer leg portion 46, which is also substantially planar, is formed with numerous punched prongs 48 that, in the assembled casing, pierce the casing body walls and are bent over and slightly out at their tips into the casing walls (to eliminate a sharp exposed tip) to secure the members to the body.

The juncture between the two leg portions 40 and 46 is formed by a flange portion 50 that is of a width slightly greater than that of the bars 36. Along each margin of the flange portion is a row of U-shaped slits 52 formed by slitting and bending in slightly small rectangular segments 54 of the metal band from which the member is formed. The longer portions of the slits—the portions that extend lengthwise of the member—define fold lines along which the inner leg portion of the member is folded by the user into the inside of the casing body when the casing is erected (see FIG. 3).

When the reinforcing member is properly folded over the edge of the casing wall, the respective leg portions should form right angles with the flange portion. Although the reinforcing member 38 shown in FIGS. 1 to 5 has served well over many years of widespread use, one of its shortcomings is that the user does not always form the fold at the flange properly. If one fold line is folded sharply, it becomes somewhat weaker than it should be, and it also presents a sharp edge. Moreover, the existence of the slits presents sharp corners, even when the member is folded correctly. The presence of the two fold lines also creates two lengthwise lines of weakness along the edge of the member, where the respective leg portions of the member are joined to the flange portion by only a series of relatively narrow, spaced-apart strands 56 of the metal between the ends of the adjacent slits.

SUMMARY OF THE INVENTION

An object of the present invention is to provide a shipping and storage casing in which the reinforcing members are configured such that they are not subject to being folded improperly, are stronger and stiffer and present at the juncture of the external leg portion and the flange portion a continuous smooth corner free of sharp edges. The foregoing and other objects are attained, according to the invention, by a shipping and storage casing comprising a body of sheet material having top, bottom and side walls, a rectangular opening at one end, and a unitary metal reinforcing member affixed to the edge of the body along each of two opposite sides of the rectangular opening. Each reinforcing member includes a first elongated substantially planar leg portion, a narrow substantially planar flange portion joined along one edge integrally to the first leg portion along one edge thereof along a continuous smooth juncture free of interruptions and disposed substantially orthogonally to the first leg portion, and a second elongated substantially planar leg portion joined integrally to the other edge of the flange portion along a bending line defined by spaced-apart perforations. The first leg portion of each reinforcing member is secured to one face of the sheet material adjacent the opening, the flange portion extends over the edge at substantially right angles to the first leg portion, and the second leg portion extends from the flange portion in a direction opposite from the first leg portion. In this form the casing is conveniently shipped to the customer and stored until it is needed. When the casing is erected, the second leg portion is bent along the bending line into engagement with the other face of the sheet material.

Preferably, the bending line of each reinforcing member is in the form of elongated, aligned slits, and the edges of each slit are deformed such that they bend at angles to the planes of the second leg portion and the flange portion, respectively. When the member is installed on the casing, the bent edges extend toward the sheet material of the body wall on the inside of the casing and butt together, which virtually eliminates sharp edges. Advantageously, the first leg portion of each reinforcing member is located outside of the casing, and the second leg member is located on the inside of the casing, so that the smooth juncture between the first leg portion and the flange portion is located on the outside of the casing.

For a better understanding of the invention reference may be made to the following description of an exemplary embodiment, taken in conjunction with the accompanying drawings.

DESCRIPTION OF THE DRAWINGS

FIG. 14 is an enlarged fragmentary cross-sectional view of a detail of the reinforcing member (also the area of the circle 10 in FIG. 9) after it is bent to its finally assembled position in the casing body.

DESCRIPTION OF THE EMBODIMENT

Figure 1:
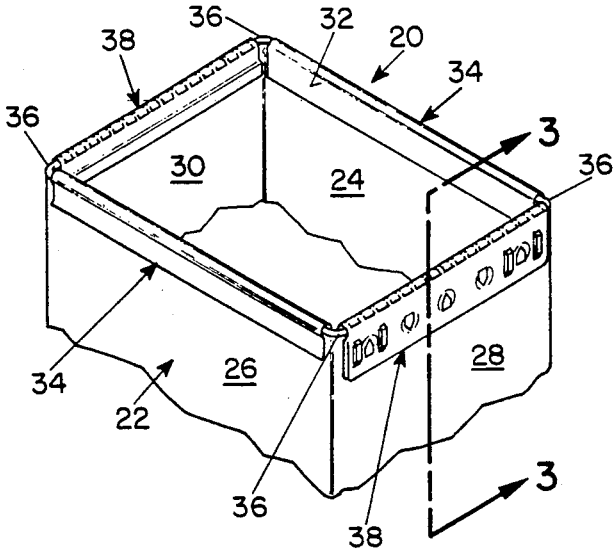
FIG. 1 (PRIOR ART)
FIG. 1 is a fragmentary perspective view of a portion of a prior art casing, the portion being at the open end.
Figure 2:
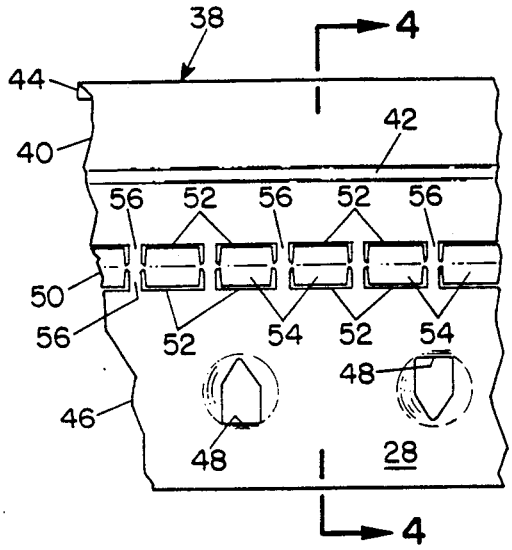
FIG. 2 (PRIOR ART)
FIG. 2 is a fragmentary elevational view of a prior art reinforcing member showing it as it is initially formed.
Figure 4:
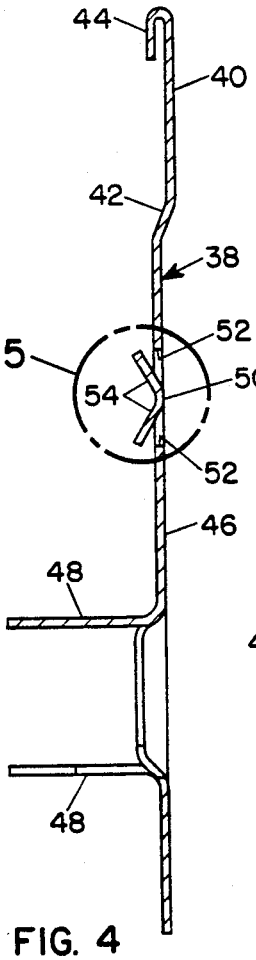
FIG. 4 (PRIOR ART)
FIG. 4 is a cross-sectional view of the reinforcing member taken along the lines 4—4 of FIG. 2.
Figure 3:
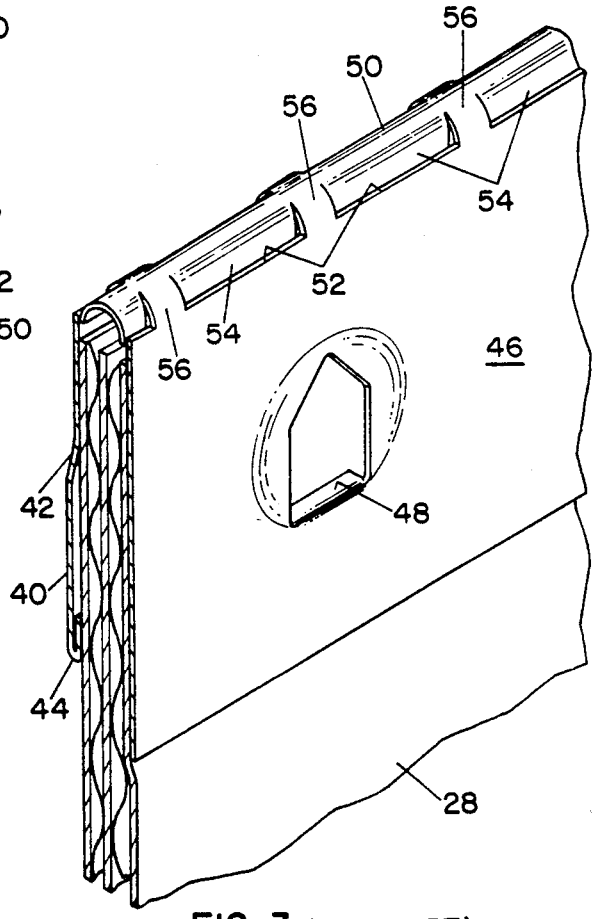
FIG. 3 (PRIOR ART)
FIG. 3 is an enlarged fragmentary perspective view of a portion of a side wall of the casing and reinforcing member of FIG. 1.
Figure 5:
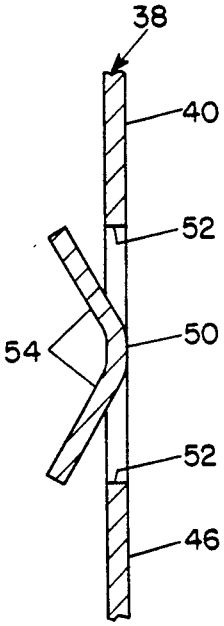
FIG. 5 (PRIOR ART)
FIG. 5 is an enlarged fragmentary cross-sectional view of a detail of the reinforcing member, as indicated by the circle 5 of FIG. 4.
Figure 6:
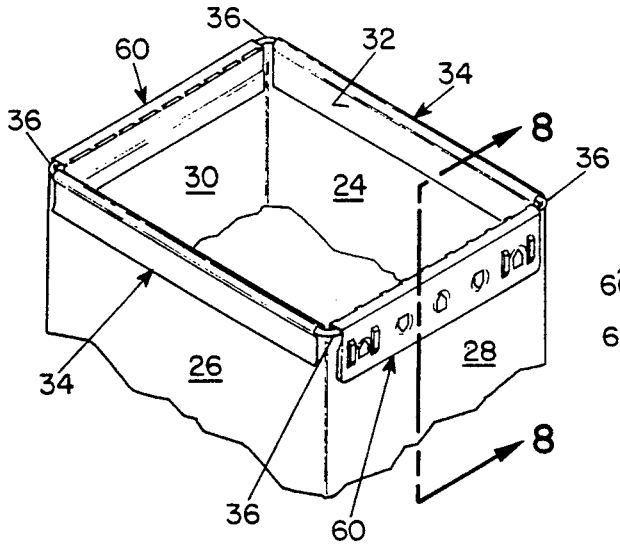
FIG. 6 is a fragmentary perspective view of a portion of a casing embodying the present invention.
Figure 7:
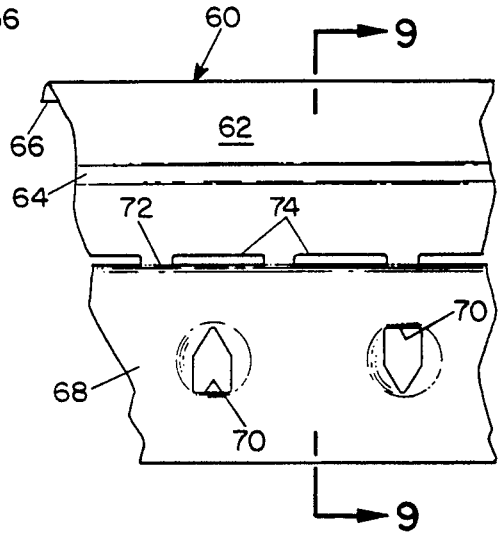
FIG. 7 is a fragmentary view of the reinforcing member of the casing of FIG. 6.
Figure 9:
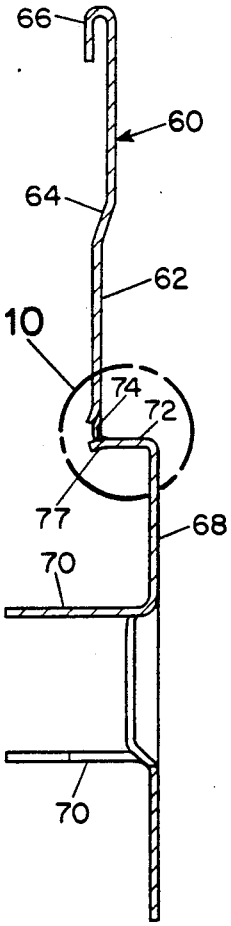
FIG. 9 is a cross-sectional view of the reinforcing member, taken along the lines 9—9 of FIG. 7.
Figure 8:
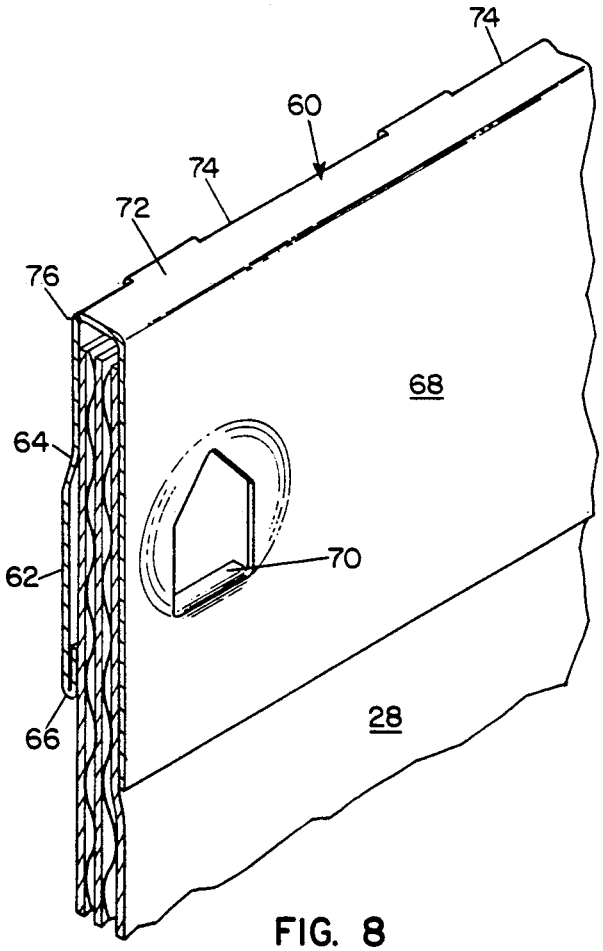
FIG. 8 is an enlarged fragmentary perspective view of a portion of a side wall of the casing and reinforcing member of FIG. 6.

The corrugated boxboard body, the reinforcing elements on the edges of the top and bottom walls of the body and the bars that shape the rectangular opening are the same as the prior art casing shown in FIGS. 1 and 4 and described above. Accordingly, they are designated by the same reference numerals in FIGS. 6 and 8, and the description of them is not repeated. The reinforcing members 60 comprise an inner leg portion 62 that is substantially planar, but with an offset 64 such that a rolled bead 66 at the free edge providing a standoff is accommodated. An external leg portion 68 has stamped prongs 70 that pierce the body side walls and are bent over and slightly out into the casing sheet material to fasten the member to the body. The respective leg portions are joined to a flange portion 72. The external leg portion 68 and the flange portion 72 are joined at a 90 degree angle, which is formed when the member is manufactured, and the juncture between them is smooth and continuous and uninterrupted by slits or the like.

Figure 10:
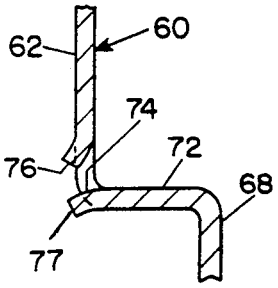
FIG. 10 is an enlarged fragmentary cross-sectional view of a detail of the reinforcing member, as indicated by the circle 10 in FIG. 9.
Figure 11:
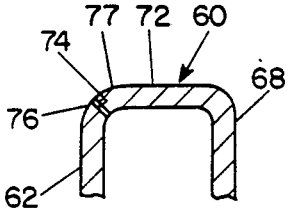

As initially manufactured, the leg portion 62 of the reinforcing member forms a 90 degree angle with the flange portion 72 and extends from it in a direction away from the flange portion 68. A row of aligned, lengthwise, longitudinally spaced-apart slits 74 is formed at the juncture between the external leg portion and the flange portion. The slits 74 define a bending line along which the leg portion 62 bends relative to the flange portion 72 when the casing is erected. The edges 76 and 77 of the slits 74 are bent slightly in a direction away from the planes of the leg portion 62 and flange portion 92 (see FIG. 10), so that when the internal leg portion 62 is bent into place against the inside surface of the wall of the casing body, the edges 76 and 77 butt together and virtually eliminate exposed sharp edges (see FIG. 11).

Like the prior art casings (FIGS. 1 to 5), the casing of the present invention is supplied with the body collapsed and with the reinforcing elements 34 and reinforcing members 60 installed. The casing is erected by extending the casing walls into approximately the final shape, pivoting the bars 36 such that the arms at each end lie in the plane of the opening, and bending the internal leg portions 62 inwardly and then downwardly into place against the inner surfaces of the body side walls 28, 30, respectively. When the internal leg portions are bent into their final position, the arms of the bars 36 are automatically captured between the leg portions 62 and 68 of the reinforcing members and form a highly rigid connection between the top and bottom walls and the side walls of the casing body at the opening.

In the assembled casing (FIGS. 6, 8 and 11) the junctures between the external leg portions 68 and the flange portions 72 of the reinforcing members 60 are presented at the external edge of the casing side walls, and because it is smooth and continuous, there are no sharp edges. The continuous edge is also stronger and more rigid than the slit external edge of the prior art reinforcing member. In general the reinforcing member is stronger because there is only one row of slits and the slits are straight rather than U-shaped. Accordingly, the number of stress riser points is a small fraction of the number present in the prior art reinforcing member. The present invention also eliminates the possibility that the user will make an incorrect bend in the reinforcing member, inasmuch as the bend at the juncture between the external leg portion and the flange portion is formed when the member is manufactured. The remaining bend is inherently made correctly at 90 degrees when the internal flange is bent flat against the inside surface of the casing body, because 90 degrees of the total 180 degree difference between the angle between the leg portions as formed initially and as installed on the casing is preestablished at manufacture, and the remaining 90 degrees must result from the single bend made by the user. A not insignificant further advantage of the present invention is the better appearance of the reinforcing member 60 as compared with the prior art reinforcing member 38.

The above-described embodiment of the invention is merely exemplary, and numerous variations and modifications of it will be readily apparent to those skilled in the art without departing from the spirit of the invention. All such variations and modifications are intended to be included within the scope of the invention as defined in the appended claims.

I claim:

1. A shipping and storage casing of sheet material having a unitary metal reinforcing member affixed to the edge of the sheet material along each of two opposite sides of an opening into the casing, each reinforcing member comprising a first elongated substantially planar leg portion affixed to one face of the sheet material adjacent the opening, a narrow substantially planar flange portion joined along one edge integrally to the first leg portion along one edge thereof along a continuous smooth juncture free of interruptions and disposed substantially orthogonally to the first leg portion such as to overlie the edge of the sheet material, and a second elongated substantially planar leg portion joined integrally to the other edge of the flange portion along a bending line defined by vestigial segments of the member located between spaced-apart perforations and being adapted to be bent along the bending line into engagement with the other face of the sheet material adjacent the edge thereof.

2. A shipping and storage casing according to claim 1 wherein in each reinforcing member the second leg portion extends from the flange portion at substantially a right angle in a direction opposite from the first leg portion.

3. A shipping and storage casing according to claim 2 wherein in each reinforcing member the perforations are elongated slits aligned along the bending line and the edges of each slit are deformed such that they bend at angles to the planes of the second leg portion and flange portions, respectively, whereby when the member is installed on the casing said bent edges butt together.

4. A shipping and storage casing according to claim 1 wherein the first leg portion of each reinforcing member is located outside of the casing and the second leg portion is located on the inside of the casing, whereby the smooth juncture between the first leg portion and the flange portion is located on the outside of the casing.

5. A shipping and storage casing according to claim 1 and further comprising reinforcing elements along the remaining two sides of the opening including U-shaped bars, each of which has an arm portion at each end that extends into a portion of a corresponding reinforcing member between the leg portions thereof, and wherein the flange portion of each reinforcing member has a width substantially equal to the thickness of the bar.

* * * * *